US007673755B2

(12) United States Patent
Gemmill

(10) Patent No.: US 7,673,755 B2
(45) Date of Patent: Mar. 9, 2010

(54) MECHANICAL SEPARATOR

(75) Inventor: Terrence N. Gemmill, Mill Creek, WA (US)

(73) Assignee: StallGem Manufacturing Co., LLC, Mill Creek, WA (US)

( * ) Notice: Subject to any disclaimer, the term of this patent is extended or adjusted under 35 U.S.C. 154(b) by 480 days.

(21) Appl. No.: 11/513,868

(22) Filed: Aug. 30, 2006

(65) Prior Publication Data

US 2008/0053877 A1 Mar. 6, 2008

(51) Int. Cl.
*B07B 1/49* (2006.01)

(52) U.S. Cl. ..... 209/405; 209/341

(58) Field of Classification Search ..... 209/325, 209/341, 405, 420

See application file for complete search history.

(56) References Cited

U.S. PATENT DOCUMENTS 3,805,955 A * 4/1974 Bixby et al. ..... 209/395
3,840,116 A * 10/1974 Voll ..... 209/522
4,122,001 A * 10/1978 Snyder ..... 209/675
4,997,566 A * 3/1991 Davis ..... 210/433.1
5,794,787 A * 8/1998 Johnston ..... 209/420
5,927,513 A * 7/1999 Hart ..... 209/677
6,334,538 B1 * 1/2002 Nettles ..... 209/418
6,685,029 B2 * 2/2004 Forrest ..... 209/405

OTHER PUBLICATIONS

Webpage for product called The Green Machine www.woodypet.com.
Webpage for product called The Stall Shi*fter® www.brockwoodfarm.com.

* cited by examiner

*Primary Examiner*—Patrick H Mackey
*Assistant Examiner*—Kalyanavenkateshware Kumar
(74) *Attorney, Agent, or Firm*—Sound Intellectual Property PLLC

(57) ABSTRACT

A mechanical separator having a primary frame, a tray frame linked to the primary frame, and an oscillator linked to the tray frame for imparting relatively short period reciprocating and/or orbital motion thereto. The tray frame includes a plurality of tines preferably rigidly linked at their proximal ends to one end of the tray frame, and a supporting cross member that permits restricted motion of the tines when subject to kinetic impetus. The supporting cross member preferably defines holes through which the tines pass, and the distal ends of the tines are preferably free to move, being only restricted in motion by the supporting cross member. The tray frame is preferably suspended from the primary frame by extension members, which also provide for tilt, elevation and vibration isolation features.

21 Claims, 5 Drawing Sheets

MECHANICAL SEPARATOR

BACKGROUND OF THE INVENTION

The mechanical separation of constituents comprising a commingled material has been an ages old art. These separation actions have applied to food, such as separating wheat from chaff; or to minerals, such as separating gold from gold-bearing gravels. It has also applied to the separation of animal excrement from the animal's bedding. While in some areas there is an abundance of inexpensive bedding for animals wherein soiled bedding may be disposed of, for the most part, bedding is reused at least once by separating the feces there from.

The traditional means for carrying out such mechanical separation of feces from bedding has relied upon manual efforts in combination with a manure fork or other tined tool where the manure is thrown into a muck bucket or wheelbarrow. Standard manure forks for horse stalls have 18 tines, spaced about 0.75 inches apart, allowing manure particles smaller than about 0.75 inch to fall through with the used bedding. It has been estimated that approximately 20% of the manure is left behind. Newer forks with 30 tines spaced about 0.375 inches apart are an improvement, but by some measurements still allow about 15% of the manure to remain and increase the time and effort to conduct the required separation actions.

While generally effective, hand picking is tedious and time consuming. The average time to clean a horse stall is 15 to 20 minutes if done well. However, if one is required to clean many stalls over a long period of time, the manual method takes its toll on the body and can cause tennis elbow, carpal tunnel syndrome and chronic back pain. To minimize these deleterious consequences of hand picking, the cleaner will often throw good bedding away with the waste, or fail to remove all of the waste. In other words, time can be saved at the expense of bedding or bedding can be saved at the expense of time.

To address these deficiencies, power assisted mechanical separators have been developed and used. The general approach has been to emulate the process of manually mechanically separating the feces from the bedding. In this respect, these efforts have been generally successful. However, there continues to be constraints in the prior efforts of achieving a high efficiency power assisted mechanical separator, most notably the amount of kinetic energy imparted by the sifting surface to the bedding, as well as adaptability of such devices in light of changing environmental conditions such as relative humidity, temperature, and moisture content of the bedding, moisture content of the feces, binding of the feces, etc.

SUMMARY OF THE INVENTION

The invention is directed to mechanical separator particularly for use in separating animal bedding material from animal excrement. Embodiments of the invention comprise a primary frame, a tray linked to the frame, and an oscillating means for imparting relatively short period reciprocating and/or orbital motion to the tray. The tray is preferably inclined at an angle between the horizontal and vertical so that material placed on the tray will seek one end thereof during oscillation of the tray, as will be described in detail below.

The primary frame of various embodiments of the invention is constructed to retain the tray, whether in a preferably suspended relationship therewith, pivotally or rigidly. The frame may be adapted to receive a container located below the tray to retain material falling from the tray during operation of the mechanical separator. In addition, if the tray is pivotally linked to the frame, the frame may also provide for tray pivot clearance. Enhancements to the frame include provisions for wheels to assist in the movement of the frame, and antifriction surfaces on portions of the frame that may abut the tray.

In suspended embodiments of the invention, extension members link at least a portion of the tray to the frame such that the tray is vertically displaced from the frame. In certain embodiments, one end of the tray is pivotally attached to the frame while an opposing end is suspended from the frame, while in other embodiments the tray is fully suspended from the frame by extension members. The extension members may have a plurality of attachment points there on for receiving the tray at desired elevations relative to the frame. If a higher degree of isolation between the frame and the tray is desired, one or more of the extension members may be constructed from a flexible material, such as reinforced rubber.

The tray of various embodiments of the invention includes a tray frame comprising an end wall and preferably two sidewalls extending away there from. In one series of embodiments, the optional sidewalls are attached to the end wall, and generally extend orthogonally there from, to form an open-ended or "U" shaped perimeter. The tray further includes a plurality of tines, each tine having a longitudinal axis generally orthogonal to the major axis of the end wall, although such alignment is not necessary to the successful operation of the invention. At least some, and preferably all, tines are coupled to the tray at the end wall and/or the optional sidewalls. The coupling may be loose, i.e., captively coupled but not rigidly coupled, may be rigid, and/or may be a combination of loose and rigid, depending upon the location.

As noted in the preceding paragraph, association of the tines with the tray frame may take many forms and still be within the scope of the invention. It is only required that the tines be captively associated with the tray frame. Thus, at least some of the tines may be directly linked to the end wall, or may be linked to the sidewalls through a cross member. For optimal operation of the invention, it is desirable to have one end or portion approximate thereto of each tine linked to the tray frame, whether the end wall or the sidewalls. In a preferred series of embodiments, the ends of the tines are rigidly linked to the end wall of the tray frame.

The tines are further supported by a supporting cross member disposed between the linked ends and an opposite end, and which is itself linked to the sidewalls. This supporting cross member is preferably characterized as having a plurality of holes formed therein, where the holes are preferably, but not necessarily, linearly aligned. The diameter of these holes is greater than the outside diameter of the tines whereby the tines are free to move in directions other than axially within the holes. Those persons skilled in the art will appreciate that alternative configurations exist that may accomplish the same or similar results, and include slots formed in the cross member wherein the slots have a width dimension greater than the outside diameter of the tines, pairs of converging or diverging slots that cause the tines to "pinch" material placed thereon, and a plethora of other geometric shapes that may be employed depending upon use considerations. Moreover, the cross member need not captively retain the tines, but instead may vertically support and laterally restrain the tine, such as when the supporting cross member is formed by "U" or "L" shaped channel and slotted accordingly.

In a preferred series of embodiments, the supporting cross member is not positioned at or adjacent to the distal end of the tines (opposite the attached or proximal ends). In this manner, a portion of the tines are "free" or cantilevered. This arrangement maximizes the movement of the tines when the tray is oscillated or otherwise caused to shake or vibrate. This relative freedom of movement enhances the separation actions of the apparatus, and further causes aggregated clumps of material placed on the tines to break apart, thereby enhancing the operation of the apparatus.

Also in a preferred series of embodiments, the supporting cross member is removably linked to the sidewalls. In this manner, it can be disassociated from the tines with relative ease, thereby facilitating cleaning of the tines since no obstructing structure is present from the attached ends to the free ends.

Embodiments of the invention further comprise oscillating means for imparting relatively short period reciprocating and/or orbital motion to the tray. These means may be manually derived, such as by a shaking motion imparted by a user's hand, or may comprise an electric vibrator attached to the tray frame or primary frame.

DESCRIPTION OF THE PREFERRED EMBODIMENT

The following discussion is presented to enable a person skilled in the art to make and use the invention. Various modifications to the preferred embodiment will be readily apparent to those skilled in the art, and the generic principles herein may be applied to other embodiments and applications without departing from the spirit and scope of the present invention as defined by the appended claims. Thus, the present invention is not intended to be limited to the embodiment shown, but is to be accorded the widest scope consistent with the principles and features disclosed herein.

Figure 1:
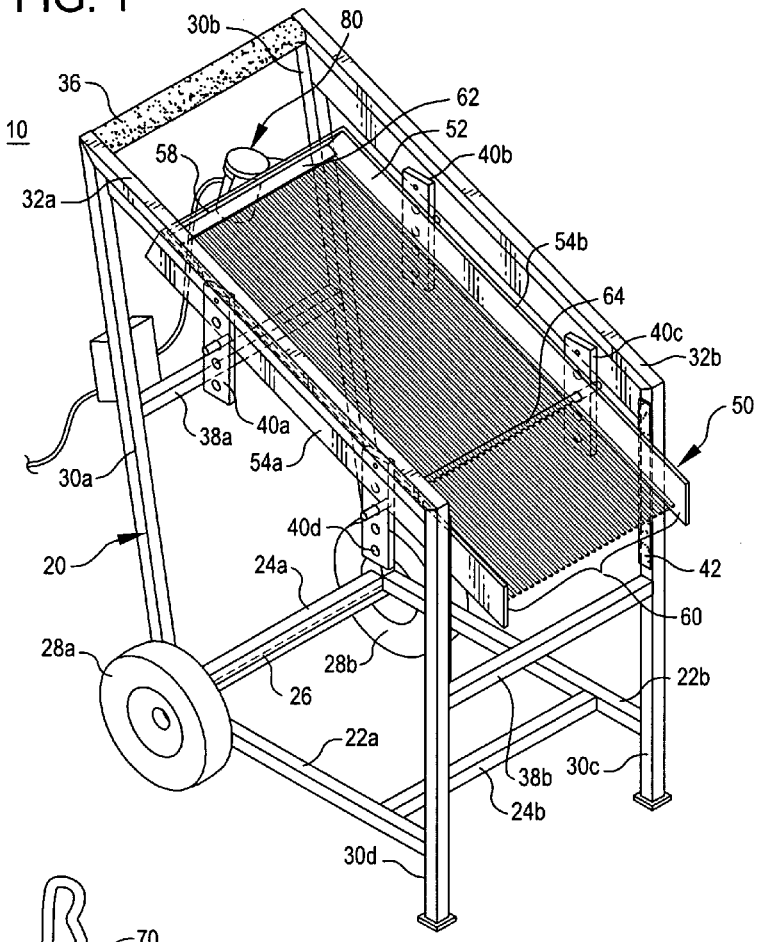
FIG. 1 is a perspective view of an embodiment of the invention showing a variable elevation/inclination mechanical separator.
Figure 2:
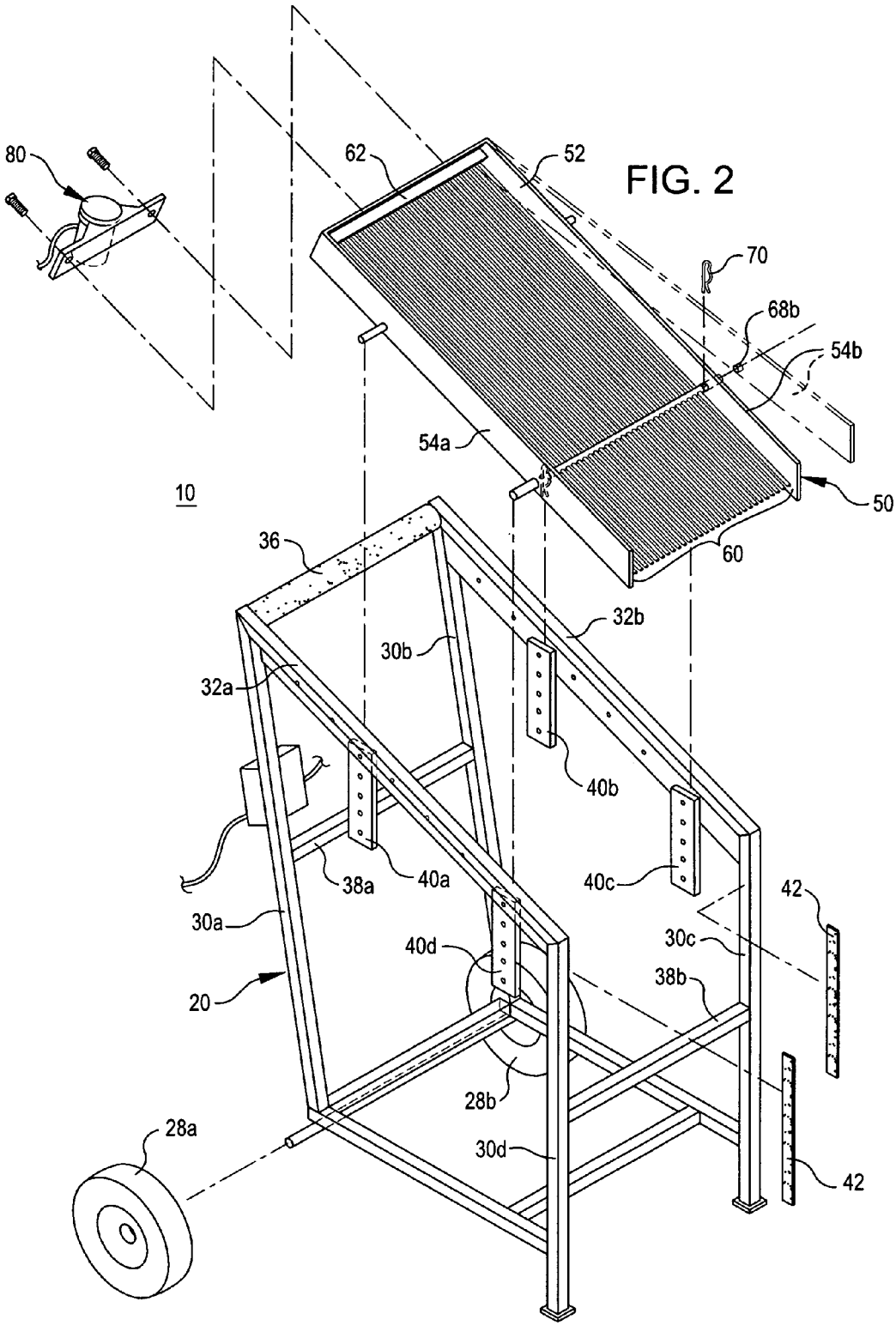
FIG. 2 is a partially exploded perspective view of the embodiment shown in FIG. 1.

Turning then to the several Figures wherein like numerals indicate like parts, and more particularly to FIGS. 1 and 2, a mechanical separator embodiment of the invention is shown. Separator 10 comprises frame 20, separating tray 50 and vibrator 80. Unless otherwise noted or apparent to persons skilled in the art, all described components are constructed from mild steel, chosen for its durability and ease of fabrication. Structural parts are preferably welded, although substitution of other fastening means will also permit the skilled practitioner to reproduce the illustrated embodiment.

Although a variety of forms are possible, frame 20 is shown as having longitudinal rails 22*a* and 22*b*, to which are attached horizontal cross members 24*a* and 24*b* in the horizontal plane, and generally vertical struts 30*a-d*. While struts 30*c* and 30*d* are generally vertical, struts 30*a* and 30*b* are diverge from the vertical away from tray 50. This geometry advantageously provides desirable clearance for tray 50 during operation of separator 10 and further moves the center of mass slightly back towards wheels 28*a* and 28*b*, thereby lessening the burden on a user when positioning separator 10 into the transport position. Additionally, frame 20 is dimensioned so as to fit within most common passageways, and in the illustrated embodiment, the width is selected as 28 inches.

As intimated above, separator 10 is intended for convenient transportation, such as from one horse stall to another. Wheels 28*a* and 28*b*, which are rotationally linked to axle 26, provide the means for achieving this objective while the depending portions of struts 30*c* and 30*d* provide desired ground contact, thereby enhancing stability while reducing weight.

Support for separating tray 50 is provided by connecting rails 32*a* and 32*b* via resilient extension members 40*a-d*. Rigidity is maintained by hand rail 36, which is firmly linked to connecting rails 32*a* and 32*b* and preferably includes a resilient gripping surface, since there is no corresponding structure at the opposite end thereof. Additional rigidity is provided by bracing cross members 38*a* and 38*b*. The relative elevation and constitution of these bracing cross members is primarily driven by the need for rigidity and clearance of tray 50 during all operating positions, as well as the need for access under tray 50.

The relative position and orientation of separating tray 50 relative to frame 20 is predominantly controlled by extension members 40*a-d*. Each extension member 40 is preferably constructed from a fabric reinforced rubber material that provides sufficient resistance to creep and sufficient load bearing properties, yet effectively isolates movement of the tray from the frame. Furthermore, each extension member 40 preferably defines a plurality of longitudinally aligned holes for receiving fasteners or other mounting means, as will be described in more detail below.

As best shown in FIG. 2, each member 40 is linked to one of connecting rails 32*a* or 32*b* at one of a plurality of mounting locations. While the preferred linkage means is by way of bolt and nut fasteners, the skilled practitioner will recognize that alternative linkage means are possible, and include using mounting studs extending from the connecting rails, as opposed to forming holes therein. It is therefore only necessary to the operation of the illustrated embodiment that extension members 40*a-d* be linked to frame 20. The alternative mounting locations provide the user with greater flexibility regarding the location of the apparatus center of mass, relative lateral position of the tray to the frame, etc. Similarly, each member 40 is linked to one of sidewalls 54*a* or 54*b*. In the illustrated embodiment, studs project from the outer portion of sidewalls 54*a* and 54*b*, as well as a portion of collars 68*a* and 68*b*.

Figure 3:
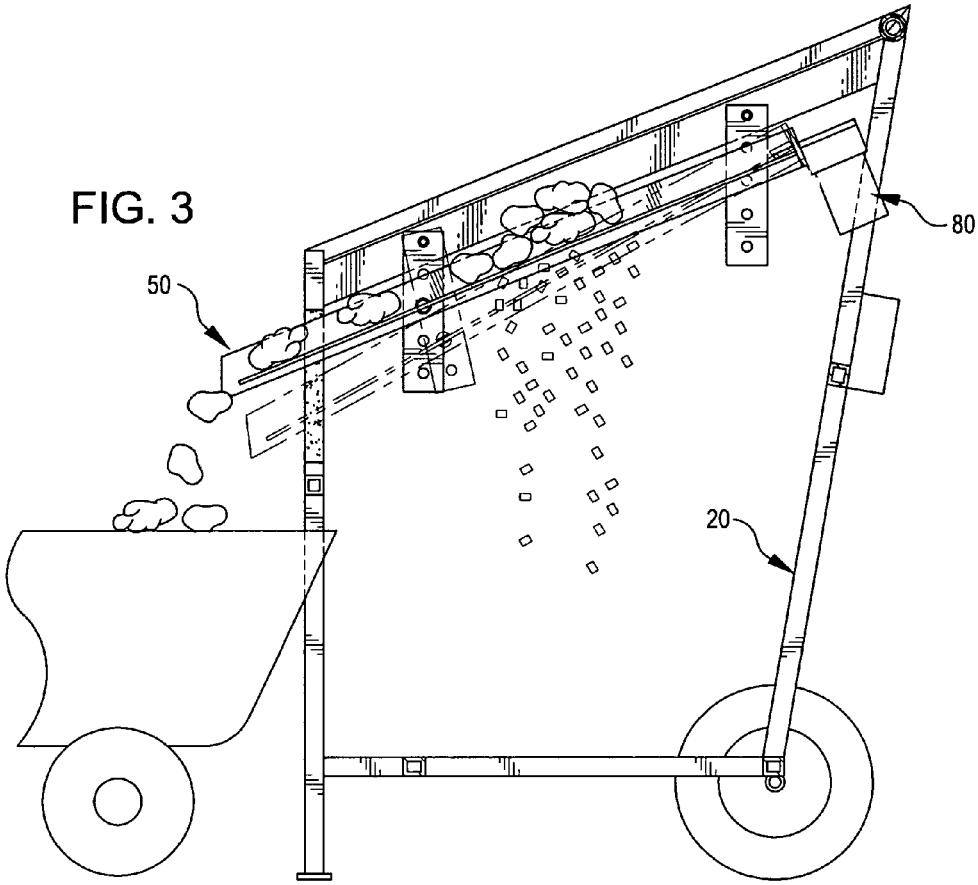
FIG. 3 is a side elevation view in partial cross section of the embodiment shown in FIG. 1 during mechanical separation of manure from a bedding material.

To provide for vertical and inclination adjustment of separating tray 50, a plurality of alternative mounting locations in the form of holes are defined by each resilient extension member 40. As FIG. 3 clearly illustrates, the inclination of separating tray 50 can be modified by changing the points of linkage between at least two members 40 and preferably sidewalls 54. In this manner, the performance of separator 10 can be easily modified in view of changing environmental conditions such as temperature and humidity, as well as changing conditions of the materials to be separated.

Separating tray 50, which is preferably constructed from stainless steel or similarly corrosion resistant and durable material, comprises frame 52, which includes opposing sidewalls 54*a* and 54*b*, and end wall 58, which serves to connect the ends of sidewalls 54*a* and 54*b*. Disposed between sidewalls 54*a* and 54*b* are a plurality of tines 60. Tines 60 are linked to frame 52 by way of channel 62 and tubular support 64.

Channel 62, which is fixedly attached to end wall 58, is sized to receive tines 60. A plurality of holes may be formed in the web portion of channel 62 to receive end portions of tines 60 where the end portions may be welded or held captive therein, such as by Circlip or other means. These holes may be sized to closely fit the tine ends, or may be oversized so that the tines are loosely held therein. Alternatively, tines 60 may be welded to one or both legs of channel 62. The selection of ultimate linkage depends upon several facts that will be discussed in greater detail below.

Figure 4:
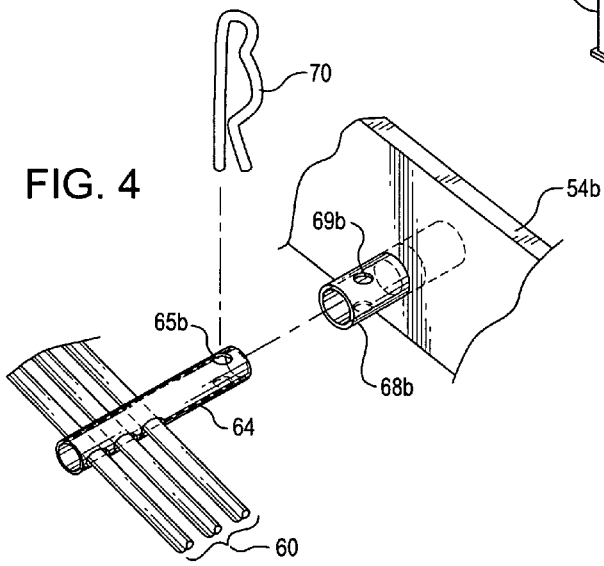
FIG. 4 is a detailed, partially exploded perspective view of the sidewall to supporting cross member interface to permit removal of the cross member from the sidewall.

Tubular support 64 is preferably removable linked to sidewalls 54*a* and 54*b* as best illustrated in FIGS. 2 and 4. Collars 68*a* and 68*b* (only 68*g* being shown) preferably extend on either side of respective sidewalls 54*a* and 54*b* as best shown in FIG. 4, which beneficially provides an attachment means for use with extension members. The inner portion of each collar 68*a* and 68*b* includes respectively through holes 69*a* and 69*b* (only 69*b* being shown) for receiving hitch pin clip 70. The inner diameter of each collar is sized to translationally receive an end of tubular support 64, which also includes through holes 65*a* and 65*b* (only 65*b* being shown), and remain selectively captive therein as illustrated.

Figure 5A:
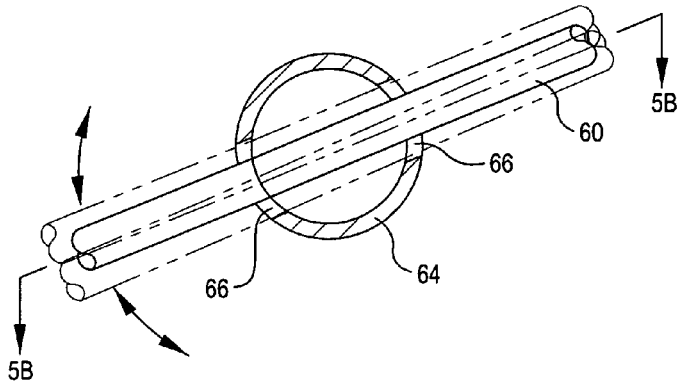
FIG. 5A is a detailed cross section elevation view of the range of vertical movement of a tine within a supporting cross member and having circular holes.
Figure 5B:
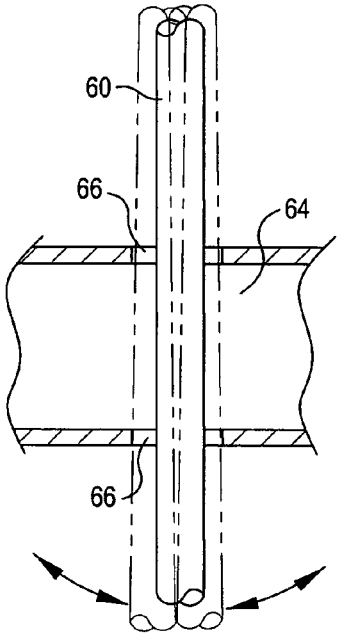
FIG. 5B is a detailed cross section plan view of the range of horizontal movement of the tine within the supporting cross member of FIG. 5A taken substantially along the line 5B-5B.

Tubular support 64 is characterized as a generally tubular member having a plurality of spaced-apart holes 66 sized to loosely receive tines 60. This loose fit permits material vertical and horizontal displacement of each tine 60 within each hole 66, as best shown in FIGS. 5A and 5B. This range limited freedom of motion provides enhanced mechanical action beneficial to the separation of aggregated material, such as animal excrement and bedding material.

Figure 6A:
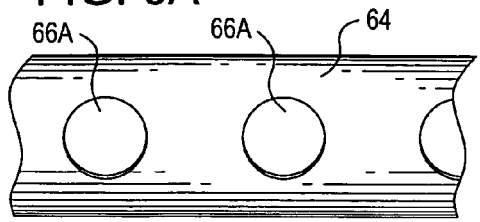
FIG. 6A is a partial elevation view of a supporting cross member having circular holes.
Figure 6B:
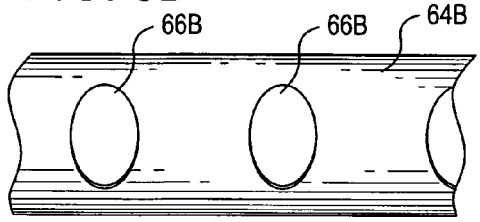
FIG. 6B is a partial elevation view of a supporting cross member having elliptical holes with the ellipse major axis being orthogonal to the tine axis.
Figure 6C:
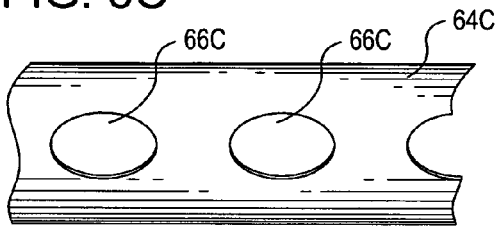
FIG. 6C is a partial elevation view of a supporting cross member having elliptical holes with the ellipse major axis being parallel to the tine axis.
Figure 6D:
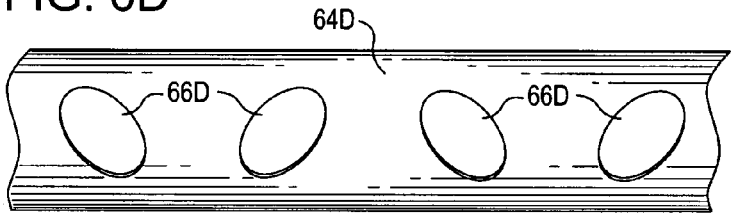
FIG. 6D is a partial elevation view of a supporting cross member having elliptical holes with the ellipse major axis being oblique and acute to the tine axis.
Figure 6E:
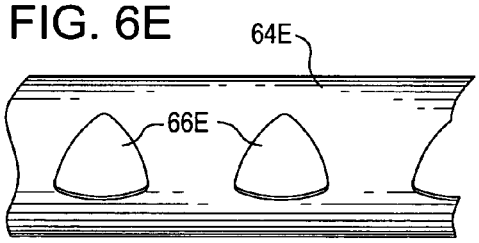
FIG. 6E is a partial elevation view of a supporting cross member having generally triangular holes with the apex pointed "up"
Figure 6F:
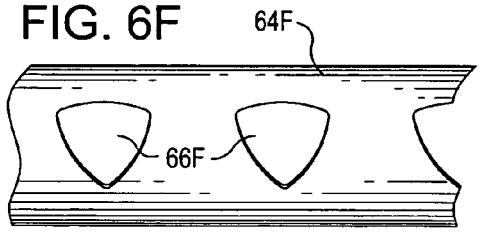
FIG. 6F is a partial elevation view of a supporting cross member having generally triangular holes with the apex pointed "down".

Depending upon circumstances, it may be desirable to tailor the quality and/or degree of tine motion during operation of separator 10. To this end, the geometry and size of holes 66 can be modified to alter the nature of tine motion and/or the magnitude of tine motion. FIGS. 6A-F illustrate alternative hole geometries that, depending upon environmental conditions, may be particularly suited for the objectives of the user. FIG. 6A illustrates generally circular holes 66A; FIG. 6B illustrates elliptical holes 66B wherein the major axis of the ellipse is in the vertical direction; FIG. 6C illustrates elliptical holes 66C wherein the major axis of the ellipse is in the horizontal direction; FIG. 6D illustrates pairs of diverging or converging (depending upon the grouping) holes 66D; FIG. 6E illustrates generally triangular holes 66E with the apex in the "up" direction; and FIG. 6F illustrates inverted triangular holes 66F. As noted above, the magnitude of tine motion is also very much affected by the size in a single or multiple directions of the holes.

Figure 7A:
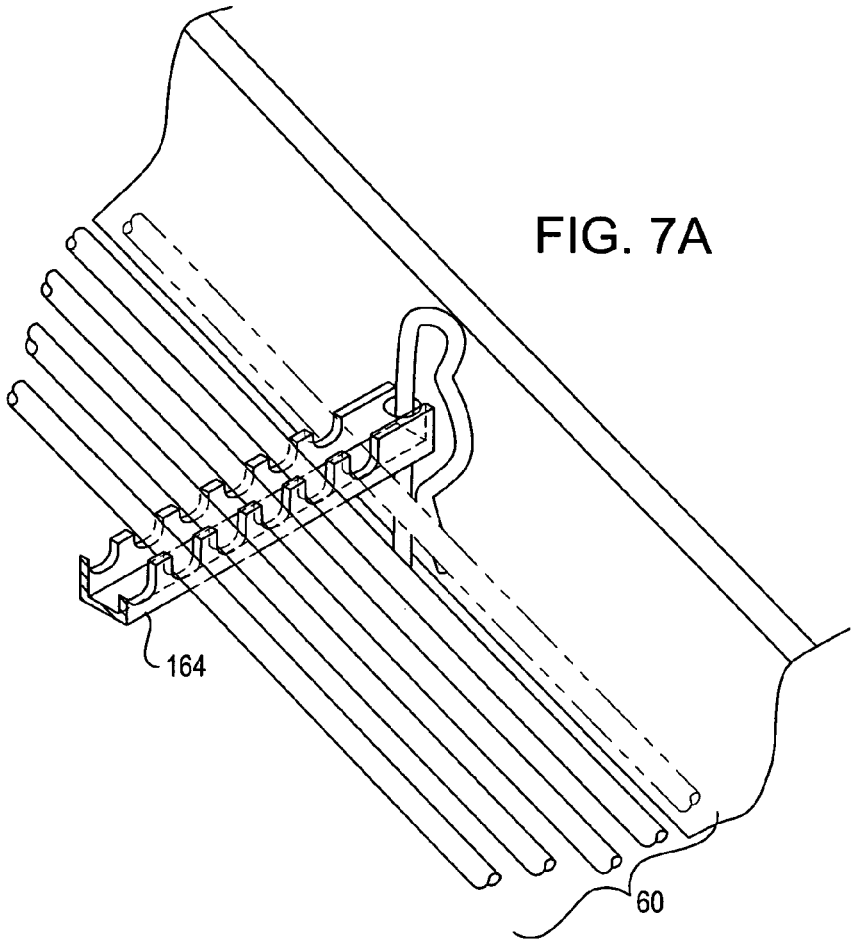
FIG. 7A is a partial perspective view of a first alternative supporting cross member for generally retaining a plurality of tines.
Figure 7B:
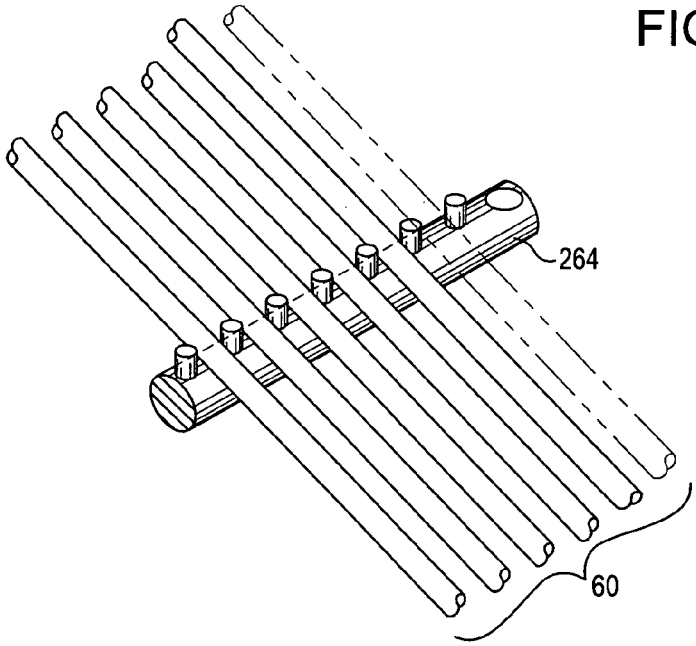
FIG. 7B is a partial perspective view of a second alternative supporting cross member for generally retaining a plurality of tines.

Those persons skilled in the art will also appreciate that alternative support members can be used, and include slotted channels or pegged stock, which are shown in FIGS. 7A and 7B where a slotted channel 164 is shown in conjunction with supported tines 60 and a pegged rod 264 is shown in conjunction with supported tines 60, respectively. However, particular advantages are found in the primary embodiment, and include reduced binding due to detritus accumulation and lack of exposed edges.

In addition to the foregoing, additional tubular supports can be introduced into tray 50 to modify the separation effect of the illustrated embodiment. In these embodiments, however, it is not necessary although not improper, to have the supports be removable or to have collars extend to the outside of sidewalls 54*a* and 54*b*.

What is claimed:

1. A mechanical separator comprising:

a primary frame;

a tray linked to the primary frame, wherein the tray comprises a tray frame having an end wall;

a plurality of tines each having a proximal end linked to the tray frame and a distal end not being linked to any structure;

a supporting cross member linked to the tray frame for supporting at least some of the plurality of tines at a location between the proximal and distal ends of the tines wherein the supporting cross member includes means for constraining tine motion in at least two directions; and oscillating means linked to one of the primary frame or the tray for imparting kinetic energy to the plurality of tines.

2. The separator of claim 1 wherein the tray is linked to the primary frame by a plurality of extension members.

3. The separator of claim 2 wherein at least some of the extension members permit a user of the separator to vary the relative distance between the primary frame and the tray.

4. The separator of claim 2 wherein at least some of the plurality of extension members are generally rigid, and when linking the primary frame to the tray, establish a generally rigid linkage there between.

5. The separator of claim 2 wherein at least some of the plurality of extension members are generally resilient, and when linking the primary frame to the tray, establish a generally resilient linkage there between.

6. The separator of claim 2 wherein a portion of the tray is pivotally linked to the primary frame and another portion of the tray is linked to the primary frame through extension members.

7. The separator of claim 1 wherein at least some of the proximal ends of the plurality of tines are loosely held captive at the end wall.

8. The separator of claim 1 further comprising first and second sidewalls laterally displaced along the end wall, and extending in a direction substantially parallel to the plurality of tines.

9. The separator of claim 1 wherein the means for constraining tine motion comprises a plurality of holes defined by the supporting cross member through which a corresponding plurality of tines extends, wherein the holes are sized larger than a maximum external dimension of the tines in order to permit relative movement of any tine within any hole.

10. The separator of claim 9 wherein at least some of the holes have a circular cross section.

11. The separator of claim 9 wherein at least some of the holes have a non-circular cross section.

12. The separator of claim 9 wherein at least some of the holes have a circular cross section and at least another some of the holes have a non-circular cross section.

13. The separator of claim 9 wherein at least some of the holes direct adjacent tines to converge or diverge during vertical motion imparted by the oscillation means.

14. The separator of claim 1 wherein the means for constraining tine motion comprises a plurality of slots defined by the supporting cross member in which a corresponding plurality of tines rests.

15. A mechanical separator comprising:

a primary frame;

a tray linked to the primary frame, wherein the tray comprises a tray frame having an end wall;

a plurality of tines each having a proximal end linked to the tray frame and a distal end not being linked to any structure;

supporting cross member means linked to the tray frame for supporting at least some of the plurality of tines at a location between the proximal and distal ends of the tines wherein the supporting cross member includes means for constraining tine motion in at least two directions; and a vibrator linked to one of the primary frame or the tray for imparting kinetic energy to the plurality of tines.

16. The separator of claim 15 wherein the supporting cross member means includes means for constraining tine motion in at least three directions.

17. The separator of claim 15 wherein the supporting cross member means is removably linked to first and second sidewalls that are laterally displaced along the end wall, and extend in a direction substantially parallel to the plurality of tines, and to the at least some of the plurality of tines.

18. The separator of claim 8 wherein the supporting cross member is removably linked to the first and second sidewalls, and to the at least some of the plurality of tines.

19. The separator of claim 1 wherein the supporting cross member is selectively locatable along the longitudinal direction of the tines.

20. The separator of claim 1 wherein the supporting cross member is not orthogonally positioned relative to at least some of the plurality of tines.

21. The separator of claim 16 wherein the means for constraining tine motion in at least three directions comprises one of holes or slots formed in the supporting cross member means.

* * * * *